US008225580B2

(12) United States Patent
Peneder

(10) Patent No.: US 8,225,580 B2
(45) Date of Patent: Jul. 24, 2012

(54) FORMWORK SUPPORT WITH FILLER MATERIAL IN RECESSES OF TOP AND BOTTOM CHORDS AND HAVING END-FACE PROTECTORS OVERLYING ENDS OF THE TOP AND BOTTOM CHORDS

(75) Inventor: Johann Peneder, Ferschnitz (AT)

(73) Assignee: Doka Industrie GmbH, Amstetten (AT)

( * ) Notice: Subject to any disclaimer, the term of this patent is extended or adjusted under 35 U.S.C. 154(b) by 1013 days.

(21) Appl. No.: 10/545,145

(22) PCT Filed: Jan. 26, 2004

(86) PCT No.: PCT/EP2004/000621

§ 371 (c)(1),
(2), (4) Date: Aug. 10, 2005

(87) PCT Pub. No.: WO2004/072408

PCT Pub. Date: Aug. 26, 2004

(65) Prior Publication Data

US 2006/0070339 A1 Apr. 6, 2006

(30) Foreign Application Priority Data

Feb. 11, 2003 (DE) ..... 103 05 613

(51) Int. Cl.
*E04C 3/14* (2006.01)
*E04C 3/29* (2006.01)

(52) U.S. Cl. ..... 52/841; 52/847

(58) Field of Classification Search ..... 52/837, 52/838, 839, 841, 836, 847
See application file for complete search history.

(56) References Cited

U.S. PATENT DOCUMENTS

| | | | | |
|---|---|---|---|---|
| 2,049,926 | A * | 8/1936 | Rafter | 52/837 |
| 2,178,940 | A * | 11/1939 | Rhodes | 52/847 |
| 2,448,362 | A * | 8/1948 | Earhart | 52/838 |
| 3,487,518 | A * | 1/1970 | Hopfeld | 29/897.35 |
| 3,960,637 | A * | 6/1976 | Ostrow | 52/841 |
| 4,219,980 | A * | 9/1980 | Loyd | 52/837 |
| 4,580,380 | A * | 4/1986 | Ballard | 52/839 |

(Continued)

FOREIGN PATENT DOCUMENTS

AT 403 305 B 1/1998

(Continued)

OTHER PUBLICATIONS

International Search Report, PCT/EP2004/000621, issued Jun. 4, 2004.

*Primary Examiner* — Michael Safavi
(74) *Attorney, Agent, or Firm* — Fitch, Even, Tabin & Flannery, LLP

(57) ABSTRACT

The aim of the invention is to improve the load-bearing capacity of formwork supports during shock-type stress that is effective especially perpendicular to or at an angle from the longitudinal axis of the support. Said aim is achieved by a formwork support which is made essentially of wood and is provided with a top chord, a bottom chord, and a web that connects the two chords. The web and/or at least one of the chords comprises at least one recess in at least one final area of the support said recess being filled with a filling material that has shock-absorbing properties. The invention also relates to a method for producing such a formwork support.

9 Claims, 5 Drawing Sheets

U.S. PATENT DOCUMENTS

| | | | | |
|---|---|---|---|---|
| 4,615,163 | A * | 10/1986 | Curtis et al. | 52/836 |
| 4,852,322 | A * | 8/1989 | McDermid | 52/841 |
| 5,115,609 | A * | 5/1992 | Sing | 52/309.9 |
| 5,609,006 | A * | 3/1997 | Boyer | 52/838 |
| 5,761,872 | A * | 6/1998 | Sanford et al. | 52/841 |
| 5,802,800 | A * | 9/1998 | Meyers | 52/847 |
| 6,050,047 | A * | 4/2000 | Covelli et al. | 52/847 |
| 6,058,673 | A * | 5/2000 | Wycech | 52/837 |
| 6,494,012 | B2 * | 12/2002 | Seng | 52/841 |
| 6,505,454 | B2 * | 1/2003 | Dingler | 52/838 |
| 6,749,921 | B1 * | 6/2004 | Edwards et al. | 428/114 |
| 6,803,083 | B2 * | 10/2004 | Ensinger | 52/841 |
| 7,634,891 | B2 * | 12/2009 | Fanucci et al. | 52/841 |
| 8,011,165 | B2 * | 9/2011 | Blahut | 52/837 |
| 2001/0037621 | A1 * | 11/2001 | Seng | 52/841 |

FOREIGN PATENT DOCUMENTS

| | | | |
|---|---|---|---|
| CH | 460 311 | A | 7/1968 |
| DE | 1945716 | | 9/1966 |
| DE | 7127863 | | 10/1971 |
| DE | 72 40 306 | U | 2/1973 |
| DE | 22 15 127 | A | 10/1973 |
| DE | 43 04 438 | A1 | 8/1994 |
| EP | 0 255 110 | A2 | 2/1988 |

* cited by examiner

FORMWORK SUPPORT WITH FILLER MATERIAL IN RECESSES OF TOP AND BOTTOM CHORDS AND HAVING END-FACE PROTECTORS OVERLYING ENDS OF THE TOP AND BOTTOM CHORDS

TECHNICAL FIELD

The present invention relates to a formwork support that comprises a top chord and a bottom chord and a web which connects the two chords, the aforementioned all being made essentially of wood, and the invention further relates to a method of producing such a formwork support.

PRIOR ART

The aforementioned type of formwork support is widely used in construction engineering. The formwork supports in use on building sites are exposed, inter alia, to pronounced mechanical loads, in particular shock-type and impact-type stress, such as arises for instance whenever the supports fall down from scaffolding or the like. There is the risk that the formwork supports are damaged to such an extent that they no longer exhibit sufficient dimensional stability or even load-bearing capacity.

To remedy this situation, various protective configurations for formwork supports, in which the support ends are usually provided with caps or the like, are known in the prior art. For example, DE 43 04 438 A1 thus discloses a wooden chord support in which a top chord is connected to a bottom chord by means of a latticework type or solid-wall type web, the chord ends are protected by a cap and at least two edges are at an angle at the end face of the chords. Furthermore, AT 403 305 B discloses a formwork support comprising a top chord and a bottom chord and at least one connecting web, with an end-face protector being provided at the end face on the top chord and on the bottom chord, this protector being composed of a castable or injectable plastic that is moulded directly on the top chord or bottom chord by means of integral casting or injection moulding.

These protective devices have by all means proved themselves to be suitable to protect the formwork support from shock-type and impact-type stress that acts upon the free support end (i.e. in the support's longitudinal direction. In practice, however, the most common shock-type or impact-type stress arises essentially transverse to or at an angle to the longitudinal axis of the support, especially when the support falls down from scaffolding or the like. In the event of this type of stress transverse to or at an angle to the longitudinal direction, the impact generally occurs at an outer edge of the chord. The normally I-shaped support cross-section within the chord end gives rise to particularly critical stresses arise transverse to the fibre direction in the form of a massive deformation and/or this cross-section causes the chords to split open. Further high and hence critical concentrations of stress are therefore produced, caused by the geometry of the support and the anisotropy of the wood, in the region of the web/chord joint, especially if the chord and the web exhibit different material properties. The impact almost always causes the support to lose its usefulness since it no longer has an adequate load-bearing capacity, though at the very least it no longer has sufficient dimensional stability.

It must be remembered here that if a formwork support falls down from scaffolding or the like, both support ends are always subjected to stress, with the last support end to make impact continuing to accelerate as the first support end makes impact, whereupon the last support end hits the ground with even greater momentum. Very high stresses in the support's transverse direction arise here.

One way to protect the formwork support from this kind of stress as well was, for example, to reinforce the support by means of screwed-in or riveted steel pins or steel bolts in order to increase the support's strength in this way (EP 0 255 110 B1). This approach resulted in a certain degree of improvement to the support's load-bearing capacity in the event of shock-type stress in a transverse or diagonal direction, but was often unable to prevent effectively damage to the formwork support during normal construction-site activity.

SUMMARY OF THE INVENTION

It is the object of the present invention to provide a formwork support in accordance with the class designation, the load-bearing capacity or resistance of which is improved in the event of shock-type stress, particularly in the support's transverse or diagonal direction.

The present invention is based on the idea of protecting the formwork support not only by means of outer impact members, but of selectively designing the inner structure in such a way that the support's deformability and hence load-bearing capacity are considerably increased. For this purpose, the invention envisages that the web and/or at least one of the chords comprises at least one recess in at least one end region of the support, this recess being provided with a filling material that has shock-absorbing properties.

By designing the formwork support in accordance with the invention, especially as a result of the shock-absorbing filling material, the formwork support can, by means of deformation, avoid excessive stress peaks in the event of high loads. In this way, the load-bearing capacity of the formwork support can be boosted to a surprising degree in the event of shock-type stress, especially in the transverse or diagonal direction. At the same time, the support still has a simple structural design, because a well-known support in accordance with the class designation can be easily modified in keeping with the invention.

In accordance with an embodiment of the present invention, the at least one recess within the web is located adjacent to the top chord and/or the bottom chord. In this way, the critical transition region between the web and the chord can be protected particularly effectively, thereby especially enabling the chord to be effectively prevented from splitting as a result of the compressive force that is introduced by the web.

In the light of this situation, according to a further aspect of the present invention the at least one recess in the top chord and/or bottom chord is adjacent to the web. At the same time, this relieves the web of stress, since the web as a whole is subjected to stress in a uniform manner and without any stress peaks, which increases its load-bearing capacity.

In addition, particularly advantageous load-bearing characteristics are obtained if the two aforementioned aspects are combined such that the at least one recess extends from the web into the top chord and/or bottom chord. As a result, stress peaks in the transition region between the web and the chords can be eliminated completely, which considerably relieves both the chords and the web of stress, with the result that, overall, the load-bearing capacity is greatly boosted with respect to shock-type stress.

Particularly effective damping characteristics are achieved in accordance with an embodiment of the present invention in that the filling material essentially fills up the at least one recess.

In accordance with a further aspect of the present invention, the recesses as defined by the invention can, moreover, be very advantageously combined with an end-face protector that covers at least sectionally a formwork-support end face located in the end region. This particularly benefits the load-bearing capacity of the formwork support in the event of shock-type stress both in the transverse direction and in the longitudinal direction of the support.

In accordance with the invention, it is particularly preferred for the end-face protector to encompass the formwork support's end region at least partially in order thereby to contribute to the support's load-bearing capacity in its transverse or diagonal direction, too. At the same time, as a result of encompassing the formwork support, especially the chords, the support is reliably prevented from splitting or splintering whenever nails are hammered in or screws and bolts are screwed in.

To achieve simple production of the formwork support in accordance with the invention and to avoid joints in the support, it is preferred, in accordance with an embodiment of the present invention, for the end-face protector to be formed integrally with the filling material of at least one recess.

It has proved particularly beneficial for the filling material and/or end-face protector to be formed by a plastic material that is preferably sprayed or cast on. The use of a plastic material permits, on the one hand, advantageous damping properties and, on the other hand, a simple, rapid and cost-effective method of producing the formwork support in accordance with the invention.

Particular preference is given to a plastic material such as PUR, especially a polyether-based or polyester-based PUR casting resin. These materials can be processed using high-pressure or low-pressure techniques and are consequently, furthermore, ideal for casting on in the event of relatively low pressures. In addition, they have also proved to be beneficial on account of their excellent damping characteristics. Moreover, the PUR can be advantageously filled with additives such as fibre glass, talcum, etc.

Further preferred materials include rubber, especially EPDM rubber, and thermoplastic elastomers (TPE). Due to their excellent damping properties, TPE-S (based on styrene-ethylene-butadiene-styrene), TPE-V (based on EDM/polypropylene) and TPE-U (based on polyurethane), in particular, have turned out to be advantageous.

Nevertheless, it should be borne in mind that the filling material and/or the end-face protector can, moreover, each be applied individually or integrally as a semi-finished part (or parts), for instance by means of an adhesive or the like.

In accordance with a further aspect, the present invention envisages the end-face protector and/or the filling material to comprise at least one reinforcing member which is preferably made of steel, aluminium or fibre-reinforced plastic. In this way, the formwork support defined by the invention can be lent additional strength without impairing the advantageous deformation properties, thereby enabling the support's load-bearing capacity to be increased even further in the event of shock-type stress. In this respect, it is preferred by the invention for the reinforcing members to be formed by rings that encompass in particular the top chord and/or the bottom chord. In this way, the chords are reliably protected from splitting if a load is applied transversely or at an angle.

In addition, the present invention provides a method of producing a formwork support. The method defined by the invention makes it possible to manufacture a novel formwork support in an industrially feasible and hence economical manner, this formwork support exhibiting a considerably improved load-bearing capacity whenever shock-type stress occurs, especially in the support's transverse or diagonal direction.

If the method is to be performed comparatively simply and if a simple apparatus is to be used to perform this method, there is an advantage to casting on the filling material rather than spraying it on, in that lower pressures are used. This simplifies sealing between a casting mould or an injection mould and the outer contour of the support end.

In an embodiment of the method according to the invention, the web is securely connected to the top and bottom chords before the at least one recess is introduced. This means that the manufacture of the support can, per se, be separate from the introduction of the recesses, with the result that any support can be provided subsequently with those recesses which are necessary and beneficial in relation to individual applications.

In accordance with the invention, particular preference is given to sawing or milling in the at least one recess from an end face of the web and/or of the at least one chord. It is due to this measure that the at least one recess can be effected with particular ease and that, in particular, this recess can be easily introduced on supports that have already been finished.

Furthermore, in accordance with another aspect, the method involves applying an end-face protector that covers at least sectionally a formwork-support end face located in the end region, with particular preference being given to the fact that the filling material and/or the end-face protector is applied by spraying or casting on a plastic material, particularly in an integral manner. Alternatively, however, it is of course possible to apply the filling material and/or the end-face protector individually or integrally in each case as a semi-finished part (or parts), for example by means of an adhesive or the like.

DETAILED DESCRIPTION OF PREFERRED EMBODIMENTS

Preferred embodiments of the formwork support according to the invention will now be described in detail with reference to the attached drawings.

Figure 1:
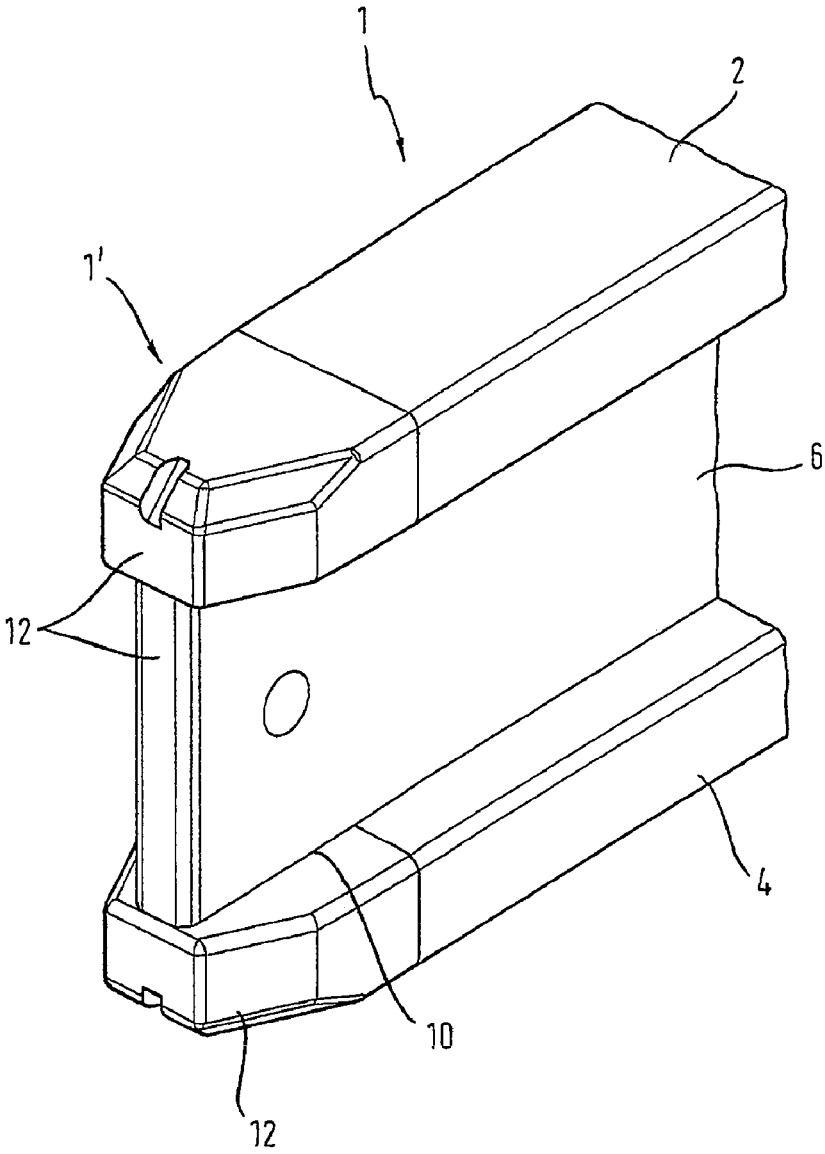
FIG. 1 shows a schematic perspective view of a first embodiment of the formwork support according to the invention.
Figure 2:
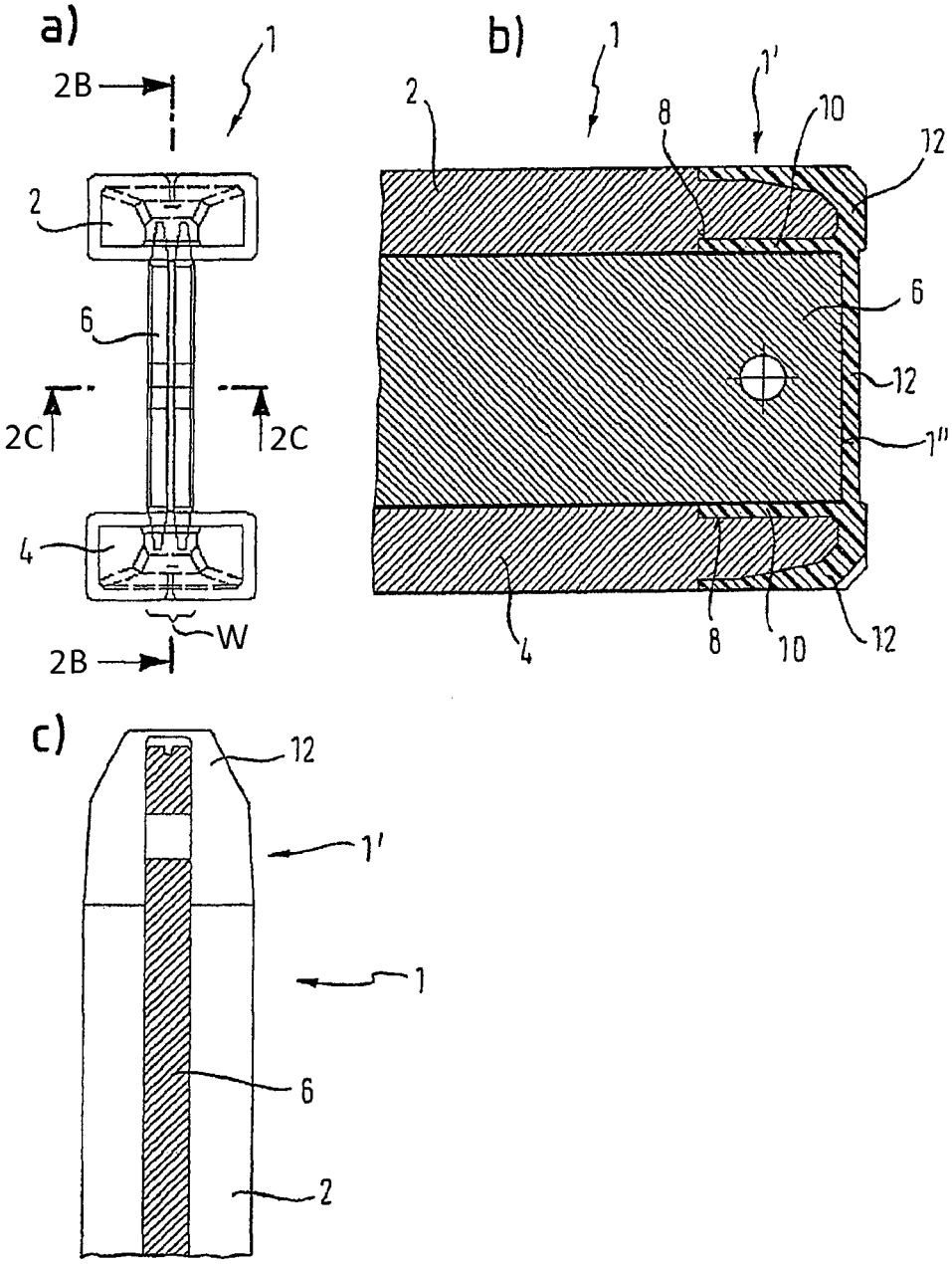
FIG. 2*a*) shows a schematic side view of the embodiment depicted in FIG. 1.
FIG. 2*b*) shows a schematic sectional view of the first embodiment of the formwork support according to the invention, with the section being made along the line 2B-2B in FIG. 2*a*)
FIG. 2*c*) shows a schematic sectional view of the first embodiment of the formwork support according to the invention, with the section being made along the line 2C-2C in FIG. 2*a*)

FIGS. 1 and 2 show schematically a first embodiment of a formwork support 1 in accordance with the invention. The formwork support 1 comprises a top chord 2, a bottom chord 4 and a web 6 that connects the two chords, the aforementioned all being made essentially of wood. The web 6 may be a solid-wall web or, for example, a trelliswork or latticework structure or the like. In the present embodiment example, the chords 2, 4 each comprise a recess 8 in an end region 1' of the support 1, this recess extending from the end face 1" of the formwork support 1 into the chords 2, 4. In the present embodiment, furthermore, the recesses 8 are arranged such that they are each located adjacent to the web 6, i.e. they adjoin same. In accordance with the invention, however, it is, moreover, possible for the recesses 8 to pass into the web 6 or just for them to be provided within the web 6, in which case an arrangement of recesses adjacent to the chords 2, 4 is preferred.

The recesses 8 each comprise a filling material 10 which has shock-absorbing properties and in the present embodiment example essentially fills up the recesses 8. Although it is preferable to fill up the recesses 8 to a large extent, embodiments with cavities or gaps in the filling material 10 are possible, too. In addition, the invention envisages the filling material 10 having in the web's transverse direction at least a width of the cover (W) between the web 6 and the chords 2, 4.

Furthermore, the formwork support 1 is provided with an end-face protector 12 that is formed integrally with the filling material 10, as can be best identified in FIG. 2*b*). The end-face protector 12 covers at least sectionally an end face 1" that is located in the end region 1' of the formwork support 1. The end-face protector 12 may also cover completely the end face 1" of the formwork support 1. Moreover, in the present embodiment, the end-face protector 12 also encompasses the lateral faces of the top chord 2 and of the bottom chord 4.

The filling material 10 and the end-face protector 12 are each made of a shock-absorbing material, particularly a thermoplastic elastomer (TPE), preferably TPE-S (based on styrene-ethylene-butadiene-styrene), TPE-V (based on EDM/polypropylene) or TPE-U (based on polyurethane), a rubber, preferably an EPDM rubber, or a PUR, preferably a polyether-based or polyester-based PUR casting resin.

Based on the embodiment of the formwork support 1 with the shock-absorbing material 10 in the recesses 8, as specified by the invention, the formwork support 1 is lent an excellent load-bearing capacity in the event of shock-type or impact-type stress, which load-bearing capacity is considerably enhanced compared to conventional supports, particularly in the support's transverse or diagonal direction. One way in which this improvement is brought about is in that, thanks to the shock-absorbing filling material, an internal resilience of the support is, to an extent, achieved, so that the support can, by means of deformation, avoid excessive stress peaks in the event of shock-type or impact-type stress. Yet the support still has a simple structural design and in particular does not require any intricate reinforcements such as steel bolts, steel caps or the like.

The formwork support 1 described above can be produced for example in the following way. First, a top chord 2, a bottom chord 4 and a web 6, which are all essentially made of wood, are joined together to form a formwork support. Alternatively, moreover, you can immediately start out with a commercially available formwork support that has a top chord 2, a bottom chord 4 and a web 6. In the present embodiment example, the recesses 8 are then sawed or milled into the web 6 from the end face 1" of the formwork support 1. Next, the filling material 10 is introduced into each of the recesses 8.

It has proved particularly advantageous for the filling material 10 and, where appropriate, an additional end-face protector 12 to be integrally applied as a result of spraying or casting a plastic material onto the formwork support 1. This achieves a rapid and economical production process, whereby a particularly good bond between the filling material 10—and the end-face protector 12—and the formwork support 1 is obtained by spraying or casting on the plastic material, because the plastic material is able to penetrate the pores of the wood.

Figure 3:
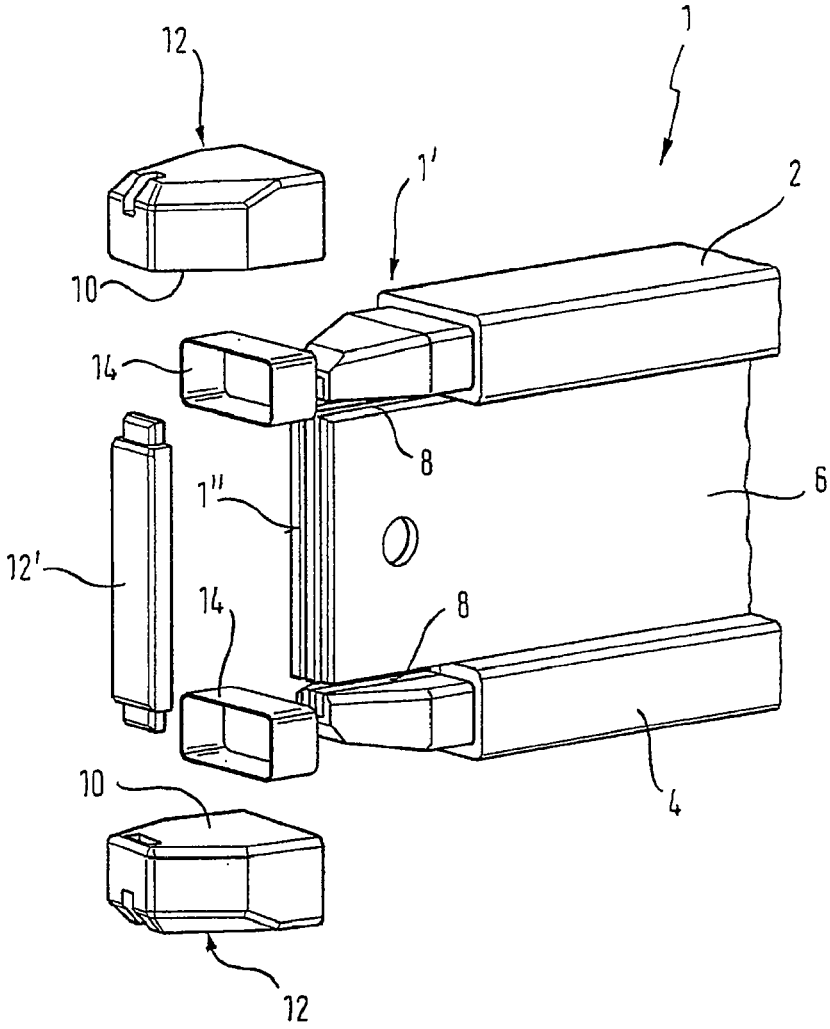
FIG. 3 shows a schematic exploded view of a second embodiment of the formwork support according to the invention.

FIG. 3 shows schematically a second preferred embodiment of the formwork support 1 in accordance with the invention. Identical or corresponding components are each provided with the same reference numbers in FIGS. 2 and 3, thus making it unnecessary to repeat the description of these components. First of all, the embodiment shown in FIG. 3 differs from the first embodiment in that the end-face protector 12 is not designed as a single component as such, but has two sections each assigned to the chords, these sections each being integral with the filling material 10 of the recesses 8, and it also has a middle section 12' assigned to the web. This arrangement has the advantage that in the region of the chords 2, 4 and of the web 6, material that is precisely tailored to the specific requirements can in each case be used as an end-face protector. It is thus conceivable, for example, for the highly stressed chord ends to each be provided with a top-quality damping material as end-face protector 12, whereas in the region of the web, use is made of a middle section 12' that does indeed exhibit sufficient damping and sealing properties, but which can otherwise be customized in terms of the design and recognition value of the formwork support.

In addition, the end-face protector in the present embodiment, to be more precise, the sections 12 assigned to the chords 2, 4, each comprise a reinforcing member 14 that extends into the reinforcing material 10 provided within the recesses 8. In the present embodiment, the reinforcing members 14 are formed by rings which each enclose the free end portions of the chords 2, 4. In this way, the formwork support 1 in accordance with the invention is lent further improved strength in addition to its excellent damping properties, thereby effectively preventing the chord ends from detrimentally splitting open.

The reinforcing members 14 may in principle be arranged at any point within the end-face protector 12 and/or the filling material 10. With regard to a particularly good efficacy of the reinforcing members 14, however, it is advantageous for the reinforcing members or reinforcing rings 14 to directly enclose the free ends of the chords 2, 4, i.e. to be directly adjacent thereto, and to be outwardly surrounded, in a shock-absorbing manner, by the filling material 10 and/or the end-face protector 12.

The reinforcing members 14 are preferably made of steel, aluminium or fibre-reinforced plastic. Equally, other reinforcing members can be used instead of rings, for instance wooden strips, wood materials, metal, plastic or fibre materials which are arranged such as to reinforce the chord wood transverse to or at an angle to the fibre direction in the region of the chord ends.

The manner of producing the second embodiment of the formwork support 1 according to the invention, as shown in FIG. 3, likewise corresponds in principle to that of the first embodiment. It must be remembered that the reinforcing members 14 are preferably fitted onto the ends of the chords 2, 4 after the recesses 8 have been introduced, in order then to integrally or gradually spray or cast the plastic material for the filling material 10 and end-face protector 12. This dispenses with any separate attachment of the reinforcing members 14 to the chord ends, because the securing members are enclosed and connected to the chord ends while the plastic material is being sprayed or cast on.

Figure 4:
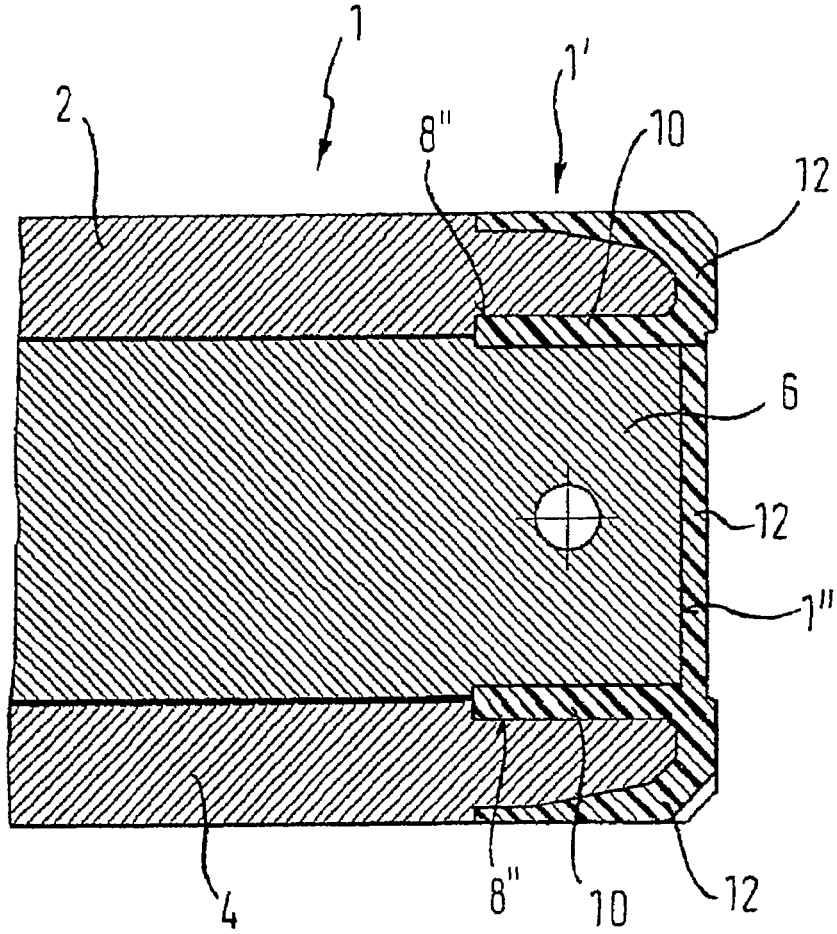
FIG. 4 shows a schematic sectional view of the formwork support with recess overlapping the web according to the invention, with the section being made along a line, which would correspond to the line 2B-2B in FIG. 2*a* of the first embodiment.
Figure 5:
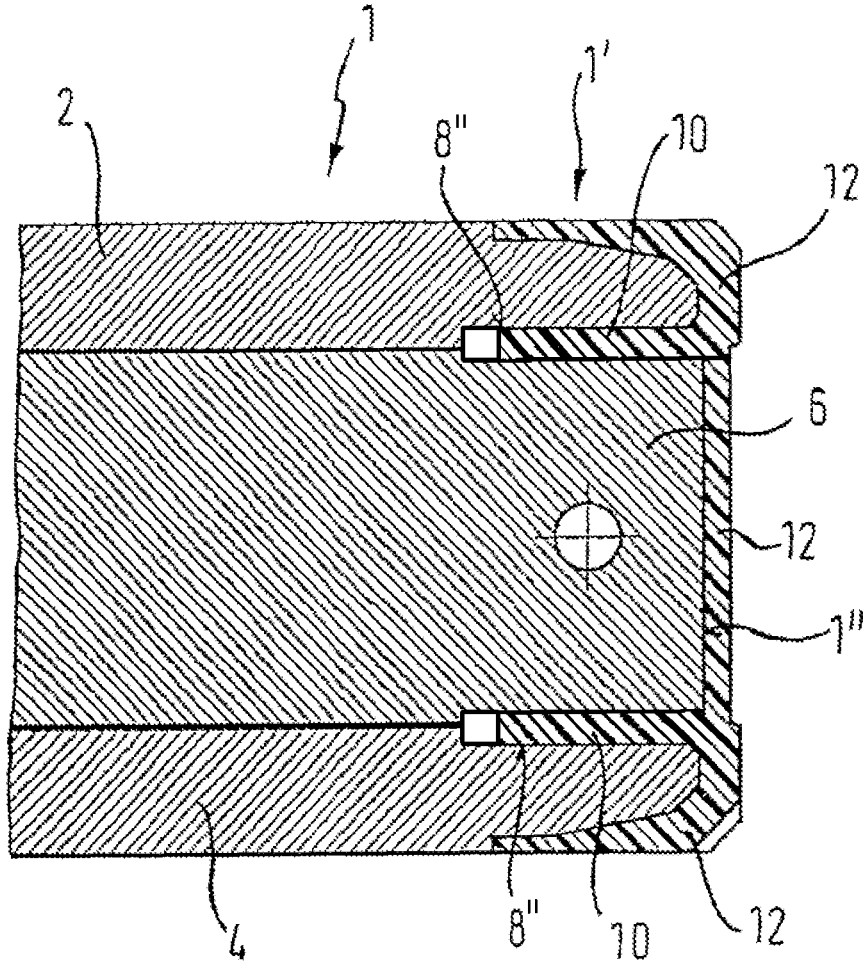
FIG. 5 shows a schematic sectional view of a formwork support having at least one recess partially filled with filling material.

FIG. 4 discloses a third embodiment of the present invention, wherein the recess 8" is located in a region of overlap of said web 6 and adjacent to that said web 6 and in the web 6.

Although the present embodiments have described a technique to spray or cast on the filling material 10 and the end-face protector 12, it is, of course, equally possible to perform a different manner of attaching these members to the formwork support 1 according to the invention without impairing the advantageous effects of the present invention, particularly the excellent damping properties and the correspondingly improved load-bearing capacity in the event of shock-type stress. In particular, the invention also provides for the filling material 10 and/or the end-face protector 12, which may each be multi-component versions as well, to be joined to the formwork support 1 by bonding or by comparable techniques.

The invention claimed is:

1. A formwork support comprising:

a top chord having a top chord length which extends longitudinally between two top chord ends, the top chord having top recesses extending longitudinally at the top chord ends along a portion of the top chord length, the top recesses including a filler material which is effective for absorbing shock;

a bottom chord having a bottom chord length which extends longitudinally between two bottom chord ends, the bottom chord having bottom recesses extending longitudinally at the bottom chord ends along a portion of the bottom chord length, the bottom recesses including a filler material which is effective for absorbing shock;

end-face protectors at each end of the top and bottom chords, the end-face protectors overlying the ends of the chords, ends of the web and covering the recesses; and a web which extends between the top and bottom chords, the recesses at the ends of the top and bottom chords being adjacent to and between the chords and the web.

2. The formwork support according to claim 1, wherein at least one of the top or bottom recesses is completely filled with the filler material.

3. The formwork support according to claim 1, wherein the filler material is formed by a plastic material which is sprayed or cast on.

4. The formwork support according to claim 1, wherein said filler material is selected from the group consisting of a rubber material, a thermoplastic elastomer and a polyurethane.

5. The formwork support according to claim 2, wherein the filler material is formed by a plastic material which is sprayed or cast on.

6. The formwork support according to claim 5, wherein the filler material is selected from the group consisting of a rubber material, a thermoplastic elastomer and a polyurethane.

7. A formwork support comprising:

a top chord having a top chord length which extends longitudinally between two top chord ends, the top chord having top recesses extending longitudinally at the top chord ends along a portion of the top chord length, the top recesses including a filler material which is effective for absorbing shock, the filler material selected from the group consisting of a rubber material, a thermoplastic elastomer and a polyurethane;

a bottom chord having a bottom chord length which extends longitudinally between two bottom chord ends, the bottom chord having bottom recesses extending longitudinally at the bottom chord ends along a portion of the bottom chord length, the bottom recesses including a filler material which is effective for absorbing shock;

a web which extends between the top and bottom chords, the recesses at the ends of the top and bottom chords being adjacent to and between the chords and the web; and end-face protectors at each end of the top and bottom chords, the end-face protectors overlying the ends of the chords, ends of the web and covering the recesses.

8. A formwork support comprising:

a top chord having a top chord length which extends longitudinally between two top chord ends, the top chord having top recesses extending longitudinally at the top chord ends along a portion of the top chord length, the top recesses including a filler material which is effective for absorbing shock;

a bottom chord having a bottom chord length which extends longitudinally between two bottom chord ends, the bottom chord having bottom recesses extending longitudinally at the bottom chord ends along a portion of the bottom chord length, the bottom recesses including a filler material which is effective for absorbing shock, the filler selected from the group consisting of a rubber material, a thermoplastic elastomer and a polyurethane and is formed by a plastic material which is sprayed or cast on;

end-face protectors at each end of the top and bottom chords, the end-face protectors overlying the ends of the chords, ends of the web and covering the recesses; and a web which extends between the top and bottom chords, the recesses at the ends of the top and bottom chords being adjacent to and between the chords and the web, and wherein at least one of the top or bottom recesses is completely filled with the filler material.

9. A formwork support comprising:

a top chord having a top chord length which extends longitudinally between two top chord ends, the top chord having top recesses extending longitudinally at the top chord ends along a portion of the top chord length, the top recesses including a filler material which is effective for absorbing shock, the filler material is selected from the group consisting of a rubber material, a thermoplastic elastomer and a polyurethane;

a bottom chord having a bottom chord length which extends longitudinally between two bottom chord ends, the bottom chord having bottom recesses extending longitudinally at the bottom chord ends along a portion of the bottom chord length, the bottom recesses including the filler material which is effective for absorbing shock;

end-face protectors at each end of the top and bottom chords, the end-face protectors overlying the ends of the chords, ends of the web and covering the recesses; and a web which extends between the top and bottom chords, the recesses at the ends of the top and bottom chords being adjacent to and between the chords and the web, wherein at least one of the filler material and the end-face protector comprises at least one reinforcing member that is made of a material selected from the group consisting of steel, aluminum and fiber-reinforced material.

* * * * *